United States Patent [19]

Firth

[11] 4,195,298

[45] Mar. 25, 1980

[54] TARGET RADAR REFLECTOR

[76] Inventor: John H. Firth, 15 The Gowers, Harlow, Essex, England

[21] Appl. No.: 917,573

[22] Filed: Jun. 21, 1978

[51] Int. Cl.[2] ..... H01Q 15/18

[52] U.S. Cl. ..... 343/18 C

[58] Field of Search ..... 343/18 C

[56] References Cited

U.S. PATENT DOCUMENTS

| | | | |
|---|---|---|---|
| 2,721,998 | 10/1955 | Holm | 343/18 C |
| 4,028,701 | 6/1977 | Parks et al. | 343/18 C |

FOREIGN PATENT DOCUMENTS

| | | | |
|---|---|---|---|
| 168322 | 8/1959 | Sweden | 343/18 C |
| 171748 | 6/1960 | Sweden | 343/18 C |
| 1468516 | 3/1977 | United Kingdom | 343/18 C |

OTHER PUBLICATIONS

"Radar Reflectors Embedded in Foam Plastic" AGA News, p. 8, 1966; Lidingo Sweden.

*Primary Examiner*—T. H. Tubbesing
*Attorney, Agent, or Firm*—Emory L. Groff, Jr.

[57] ABSTRACT

A radar reflector has at least six corner reflectors directed outwardly of a major axis. The reflectors are disposed along two successive helical paths one of which paths is sinistrorse and the other of which paths is dextrorse. In a preferred embodiment, ten corner reflectors are employed which are directed evenly about an angle of 360°.

11 Claims, 14 Drawing Figures

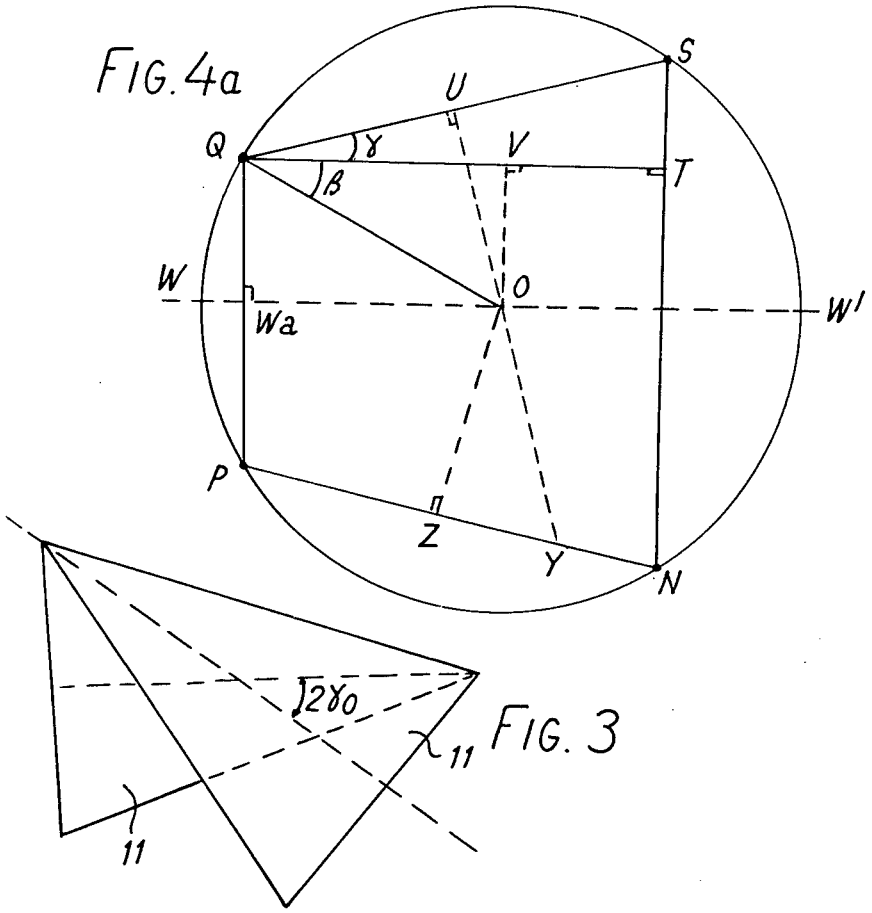
FIG. 4a
FIG. 3
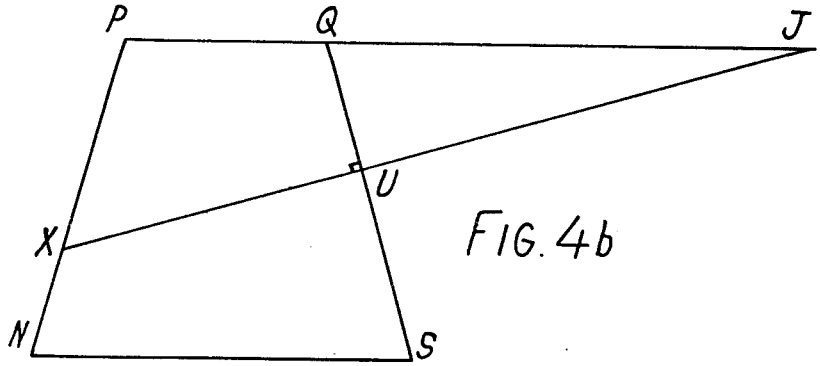
FIG. 4b

TARGET RADAR REFLECTOR

BACKGROUND OF THE INVENTION

The invention relates to radar reflectors and more particularly but not solely to such reflectors for use on sea vessels.

Radar reflectors are employed to improve the radar echoing properties of objects or land formations with a view to improving the detection of such objects or formation by radar scanning equipment. Radar reflectors of this type to be fully efficient should reflect radar waves back parallel to their initial direction.

In many applications it is advantageous if the reflector is capable of providing reflection of radar signals in any direction and in applications such as in sea vessels it is advantageous if this capability is not badly affected upon heeling of the vessel.

Corner reflectors, constructed of three sheets of reflective material which are mutually perpendicular, i.e., orthogonal re-entrant trihedrals, are known to provide effective reflection over a range of angles of incidence, with the signal strength decreasing as the obliquity increases, forming a lobe.

SUMMARY OF THE INVENTION

This invention has been arrived at by consideration of the above mentioned requirements and seeks to provide a radar reflector which provides effective reflection of signals received from any direction in a horizontal plane.

According to the invention there is provided a radar reflector comprising at least six corner reflectors directed outwardly of and disposed helically about a major axis of the reflector along two successive helical paths one of which paths is sinistrorse and the other of which paths is dextrorse.

The corner reflectors are preferably evenly distributed to cover the full 360° of horizon.

In one advantageous form of the invention ten corner reflectors are employed.

A reflector in accordance with the invention may be formed from a strip of radar reflective sheet material folded in alternate directions along fold axes spaced apart on the strip and extending transversely across the strip with two consecutive ones of the fold axes disposed intermediately being substantially parallel and the remaining folds being alternately convergent and divergent in a direction from one edge to the opposite edge of the strip the folds dividing the strip into sections adjacent sections being disposed at right angles and a separator plate being provided between and at right angles to each pair of adjacent sections to form therewith two corner reflectors. The separator plates may be rectangular but rectangular plates having one point cut off are to be preferred, the plate being positioned such that the edge where the point has been removed is remote from the adjacent sections. This cut away avoids interaction with reflections from other ones of the corner reflectors.

The edge of the strip and/or the cut away point of the separator plates can be profiled such that they have an edge profile conforming to part of the internal surface of a cylindrical housing to permit slidable and secure location of the reflector within the housing.

BRIEF DESCRIPTION OF THE DRAWINGS

In order that the invention and its various other preferred features may be understood more easily, an embodiment thereof will now be described, by way of example only, with reference to the drawings, in which:

FIG. 3 shows horizontal projections of two adjacent sections of the target radar reflector of FIG. 1 illustrating angle of twist, FIGS. 4*a* and 4*b* are circular and elliptical sections of a stepped helix.

DESCRIPTION OF THE PREFERRED EMBODIMENTS

Figure 1:
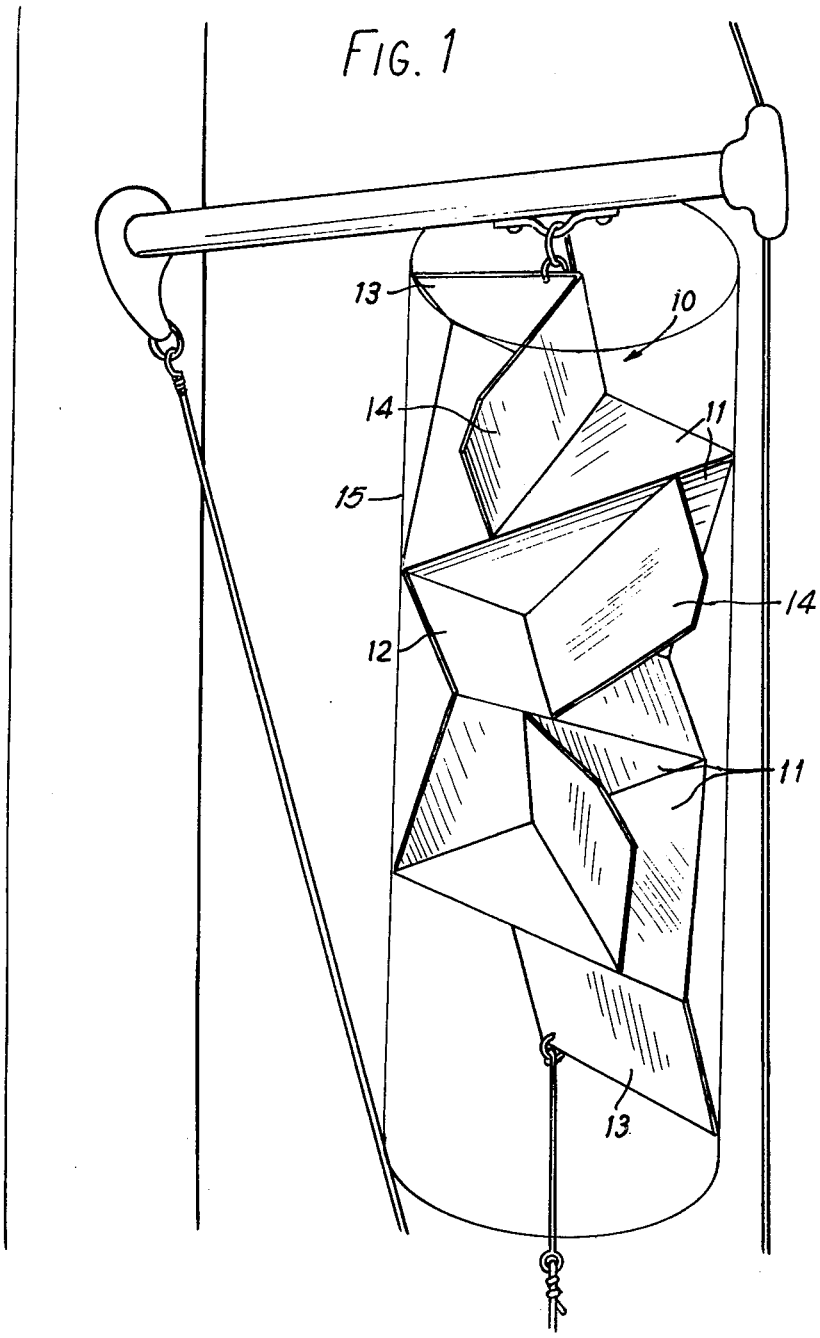
FIG. 1 is an elevational view of a radar reflector constructed in accordance with the invention.

In the drawings FIG. 1 shows a particularly advantageous form of the invention hauled up to the cross tree of a mast. The radar reflector indicated generally at 10 is formed of a strip of radar reflective material e.g. 18 s.w.g. sheet duraluminium or stainless steel. The strip is folded along axes which extend transversely across the strip in concertina fashion. The folds divide the strip into a series of sections 11, 12 and 13 adjacent ones of which are disposed at right angles. The reflector is preferably contained in a cylindrical housing 15.

Figure 2:
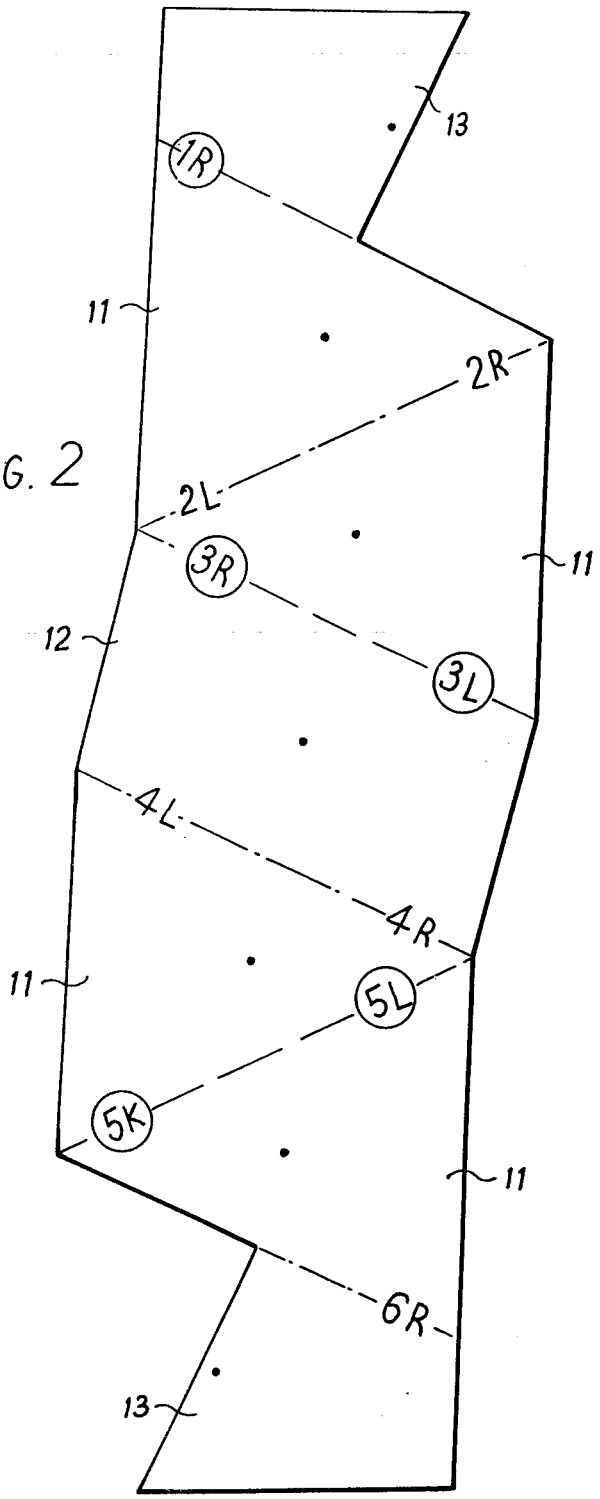
FIG. 2 shows a blank strip for bending to form the reflector of FIG. 1 illustrating the bending axes.

A flat strip suitable for folding to form in this case triangular divisions is shown in FIG. 2. The chain lines indicate axes at which the fold is to be forwards and the dot and chain lines indicate axes at which the fold is to be backwards. It will be apparent from the drawing that the fold axes in this case are all of the same length.

The folds defining the centre section 12 of the strip are parallel, the centre section being of parallelogram form. The other folds are alternately convergent and divergent in a direction from one edge to the opposite edge of the strip and divide the strip into triangular sections 11 and end sections 13 of basically trapezium form which end sections are cut away to one side of an axis extending at right angles to their adjacent fold axis to leave only the portion with the shorter side at the edge of the strip.

The folded strip forms a spine having seven sections adjacent ones of which are disposed at right angles. Each pair of adjacent surfaces of the sections is provided with a sheet metal divider 14 which is affixed thereto by for example rivetting or welding at right angles to both surfaces to form a pair of corner reflectors in the form of orthogonal re-entrant trihedrals which are capable of acting as elementary reflectors.

The radar reflector can be hung from one end from a point adjacent the axis at which the end section is cut away or can be hoisted by a similar connection at each end as shown in FIG. 1. The reflector hangs normally by its own weight with the surfaces of the sections inclined alternately at 45° above and below the horizontal.

The maximum reflecting capability of a corner reflector occurs along an axis extending equiangularly between the faces of the corner and this axis may be termed the directional axis of the reflector. When the reflector is hung as previously described the directional axes are inclined above or below the horizontal at a constant angle.

The folding of the strip to form the spine results in an effective twist or change in azimuth of each fold relative to its adjacent one. FIG. 3 shows only two adjacent sections to facilitate illustration of the twist which occurs. It will be seen that bisectors of the two sections are disposed at horizontal angles 2γo to each other. It has been discovered that if the twist is arranged such that the reflectors on adjacent folds are directed with an azimuthal displacement of about 36° then a most efficient "all round" reflection coverage results. The reflected signal strength at a lobe width of 36°, i.e. ±18° from the directional axis, is sufficiently low that overlap of the lobes of different ones of the reflective corners at this level have been found to introduce an acceptably narrow deterioration of the polar response of the radar target reflector due to phase cancellation. Accordingly ten elemental reflectors evenly disposed around a polar axis have been found to give a particularly good polar response. To provide this displacement the angle "γo" should be about 18°. It will be appreciated that in view of the twist the solid angles of the elemental reflectors all diverge radially from two helical axes one of which is sinistrorse and the other of which is dextrorse.

The sections 11 need not be triangular but can be of truncated triangular form that is of trapezium shape.

There now follows a mathematical analysis of the construction.

Stepped Helix Dimensions

The circle in FIG. 4a represents a right section of a cylinder in which are contained the stepped helices of a reflector. The trapezium shown is the projection of an actual trapezium of construction on to the circular plane which is normally horizontal. All intersections, dimensions and angles in this plane will bear a zero suffix. The actual trapezium of construction is at 45 deg to the circular plane. Its plane will be an ellipse. O, W and W' are in both planes because they are on the axis of rotation.

Note $Q_oP_o$ is parallel to $S_oN_o$ (and parallel to $OV_o$)

$\widehat{OV_oT_o}$, $\widehat{OU_oS_o}$, $\widehat{Q_oT_oS_o}$ are constructed right angles Let $Q_oS_o=P_oN_o=P_o$ $Q_oP_o=q_o$ $S_oN_o=s_o$ $OU_o=x_o$ $Q_oT_o=t_o$ $Q_oO=OS_o=r_o$ $\widehat{S_oQ_oT_o}=\gamma_o$, the half-twist angle $\widehat{O_oQ_oT_o}=\beta_o$ Problem: Given $r_o$, $\gamma_o$ and $x_o$ (i) Calculate $p_o$, $q_o$, $s_o$, $t_o$ etc, then (ii) Calculate p, q, s, t etc in the tilted plane formed by a 45 deg rotation about axis WW'.

Because $OU_o$ bisects $Q_oS_o$ $$p_o=2\sqrt{r_o^2-x_o^2} \quad (1)$$

In $\Delta OQ_oV_o$ $$q_o=2r_o \sin \beta_o \quad (2)$$

In $\Delta OQ_oU_o$ $$\tan(\beta_o+\gamma_o)=\frac{2x_o}{p_o} \quad (3)$$

Combining (2) and (3)

$$q_o = 2r_o \sin\left(\tan^{-1}\frac{2x_o}{p_o}-\gamma_o\right) \quad (4)$$

(the brackets contain $\beta_o$)

In $\Delta S_oQ_oT_o$ $$\sin\gamma_o=\frac{s_o-q_o}{2p_o}$$

$$ie\ s_o = 2p_o\sin\gamma_o+q_o \quad (5)$$

Now, in the tilted plane, $$q=q_o\sqrt{2}$$

Figure 5A:
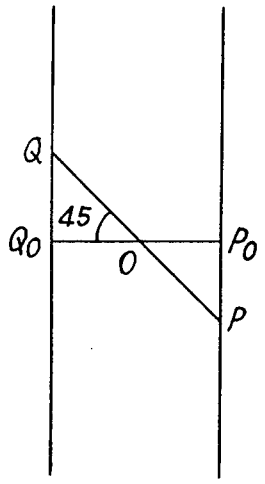
FIGS. 5*a* and 5*b* are schematic elevational views of opposite sides of a stepped helix.

(see Figure 5a)

$$s=s_o\sqrt{2}$$

Therefore, from (4) and (5)

$$q = 2\sqrt{2}\, r_o \sin\left(\tan^{-1}\frac{2x_o}{p_o}-\gamma_o\right) \quad (6)$$

and $s=2\sqrt{2p_o}\sin\gamma_o+\sqrt{2q}$ (7)

In $\Delta S_oQ_oT_o$ $$\tan\gamma_o=\frac{(s_o-q_o)}{2t} \quad (8)$$

And in $\Delta SQT$ $$\tan\gamma=\frac{(s-q)}{2t} \quad (9)$$

$$=\frac{(s_o-q_o)}{2t}\sqrt{2}$$

$$=\sqrt{2}\tan\gamma_o$$

Therefore $$\gamma=\tan^{-1}(\sqrt{2}\cdot\tan\gamma_o) \quad (10)$$

Because planes $QQ_oP_oP$ and $SS_oN_oN$ are parallel $Q_oT_o=t=QT$

Figure 5B:
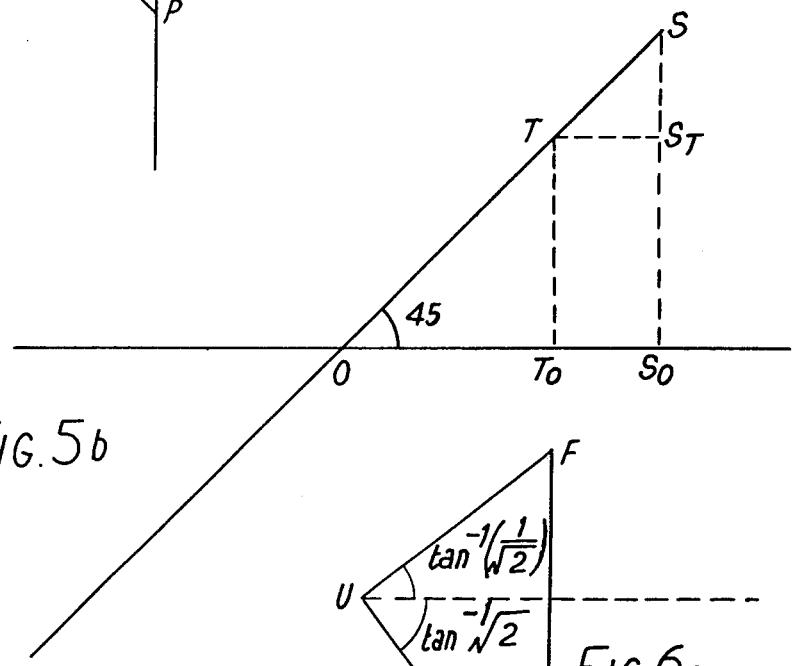

Examining the plane $SS_oN_oN$ (FIG. 5*b*), Q will be directly above T, distance t $$SS_T = \frac{ST}{\sqrt{2}} = TS_T = \frac{(s-q)}{2\sqrt{2}}$$
$$QS_T = P_o = Q_oS_o$$

Consider $\Delta SQS_T$ $$\frac{SS_T}{QS_T} = \tan \widehat{SQS_T}$$

$$\text{ie } \widehat{SQS_T} = \tan^{-1}\frac{(s-q)}{2\sqrt{2}\,p_o} \qquad (11)$$

(call this angle $\epsilon$, see later)

$$\text{also } \frac{QS_T}{QS} = \cos \widehat{SQS_T} = \frac{p_o}{p}$$

$$\therefore p = \frac{p_o}{\cos\tan^{-1}\left(\frac{s-q}{2\sqrt{2}\,p_o}\right)} = \frac{p_o}{\cos\tan^{-1}\sin\gamma_o} \qquad (12)$$

Finally note in $\Delta S_oQ_oT_o$ (FIG. 4*a*)

$$t = p_o\cos\gamma_o \qquad (13)$$

and in $\Delta OQW_Q$ $$\beta = \tan^{-1}\frac{QW_Q}{OW_Q} = \tan^{-1}\left(\frac{q}{2\,r_o\cos\beta_o}\right) \qquad (14)$$

Definition of the unit trapezium is now complete.

The position of the separator plates must now be defined. In the circular plane of FIG. 4*a* each is defined by the line $U_oO_oY_o$. $U_o$ is at the apex of the two reflecting corners. (Note however $U=U_o$, because both are in the circular and tilted planes). $O_o$ is on the cylinder axis (midway) between the intersections of the axis with adjacent trapezia. $Y_o$ is located arbitrarily on the $U_oO_o$ axis at some point within the cylinder envelope.

Because QS is tilted at angle $\epsilon$ from the horizontal, so the plane of the separator plate will be tilted at angle $\epsilon$ from the vertical. Thus the separator plate will be situated on the tilted plane QSNP at UX where X is on PN (see FIG. 4*b*). On the next PN fold above XYZ, P'N' say, there will be another point X' where the plane of the separator intersects P'N'. However, P'N' will not be in the vertical plane of PN, but another, also vertical but rotated through the twist angle. In fact UX=UX' by symmetry.

Also $\widehat{SUX}=\widehat{QUX}=\widehat{SUX'}=\widehat{QUX'}=90$ deg.

Now calculate the dimensions of the individual reflectors. They are QXX' which has edges UQ, UX, UX' and SXX' which has edges US, UX, UX'

Of these edges UQ=US (bisected chord of an ellipse, and so constructed) and UX=UX' (see above)

$$UQ = US = \frac{p}{2} \qquad (15)$$

Consider $\Delta XJP$ in FIG. 4*b*

$$\frac{q + \frac{p}{2\sin\gamma}}{\sin(90-2\gamma)} = \frac{UX + \frac{p}{2\tan\gamma}}{\sin(90+\gamma)} \qquad (16)$$

-continued $$\therefore UX = \frac{\sin(90+\gamma)}{\sin(90+2\gamma)}\left(q + \frac{p}{2\sin\gamma}\right) = \frac{p}{2\tan\gamma} \qquad (17)$$

$$= \frac{\cos\gamma}{\cos 2\gamma}\left(q + \frac{p}{2\sin\gamma}\right) - \frac{p}{2\tan\gamma} \qquad (18)$$

A hypotenuse length can now be calculated using the smallest of the edges (15) or (18) and multiplying by $\sqrt{2}$.

Ellipse Dimensions

It has been assumed this far that the stepped helix has been constructed of trapezia with sides QP and SN straight and parallel. In fact they could be extended to the wall of the enclosing cylinder when they would assume an elliptical curvature.

It can be simply shown that the smaller semi-diameter is on the axis WW' and is $r_o$, the radius of cylinder. The major semi diameter is then $\sqrt{2}\,r_o$.

Lobe Elevations and Azimuths

Let $\epsilon$ be the angle of tilt of the fold to the horizontal. This is angle $SQS_T$ described in association with FIG. 5*b*.

$$\text{From (11) } \epsilon = \tan^{-1}\frac{(s-q)}{2\sqrt{2}\,P_o} = \sin^{-1}\frac{(s-q)}{2\sqrt{2}\,p} = \sin^{-1}\left(\frac{\sin\gamma}{\sqrt{2}}\right) \qquad (19)$$

Figure 6A:
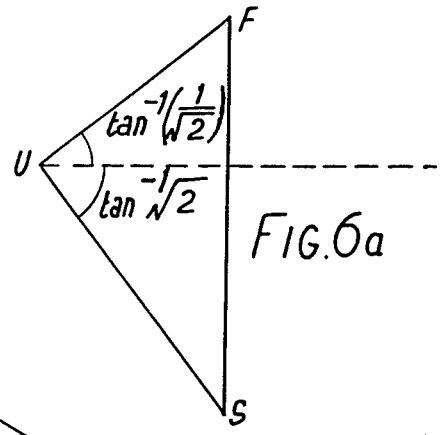
FIG. 6*a* is a schematic elevational view of a corner reflector.

Thus, in FIG. 4a direction US is inclined upwards at $\epsilon$ deg
Thus, in FIG. 4a direction UQ is inclined downwards at $\epsilon$ deg
Thus, in FIG. 4a direction $UO_o$ is inclined Horizontally Each lobe will therefore be inclined at a characteristic elevation, between 0 and $\epsilon$ deg, up or down as appropriate, as determined by its azimuth between the face and edge of the corner (see FIG. 6*a*).

Figure 6B:
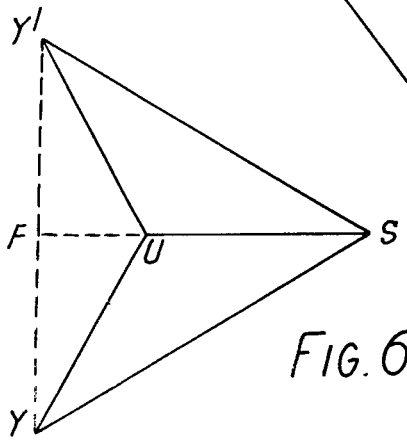
FIG. 6*b* is a schematic plan view of the corner reflector of FIG. 6*a*, FIGS. 7*a* and 7*b* are schematic tilted corner views in plan and perspective respectively.
Figure 7A:
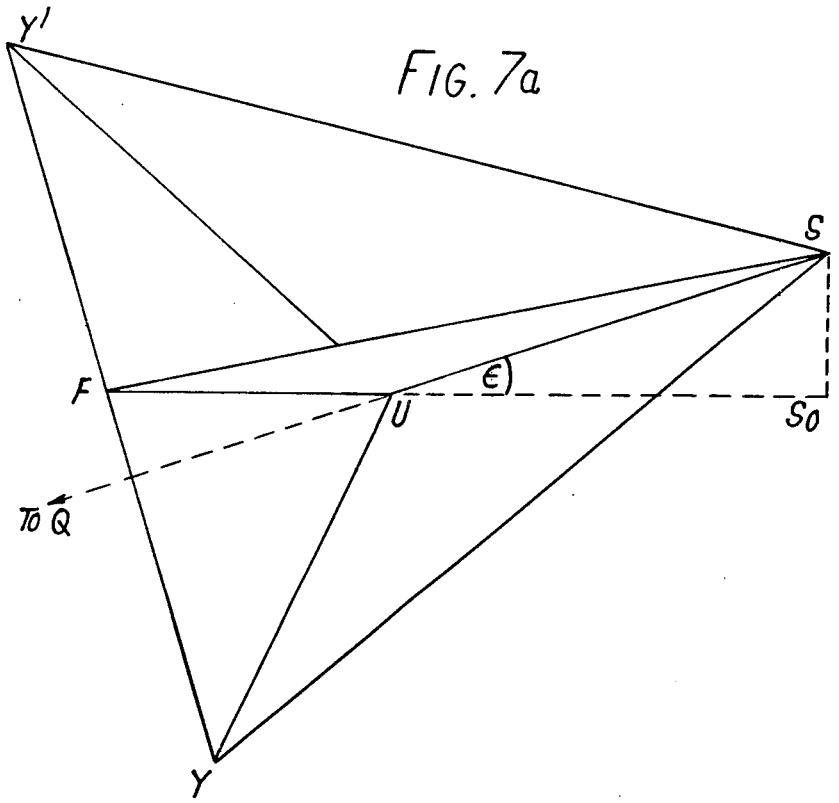

Recall that the lobe azimuth is at $$\tan^{-1}\left(\frac{1}{\sqrt{2}}\right)$$

from the face of the corner,

Recall that the lobe azimuth is at $\tan^{-1}\sqrt{2}$ from the edge of the corner, provided the plane of edge-to-face-centre is in the plane of the incident radiation (ss FIG. 6*b*). But it is not, S is tilted upwards $\epsilon$ deg about axis FU (and Q is tilted down), see FIG. 7*a*.

Figure 7B:
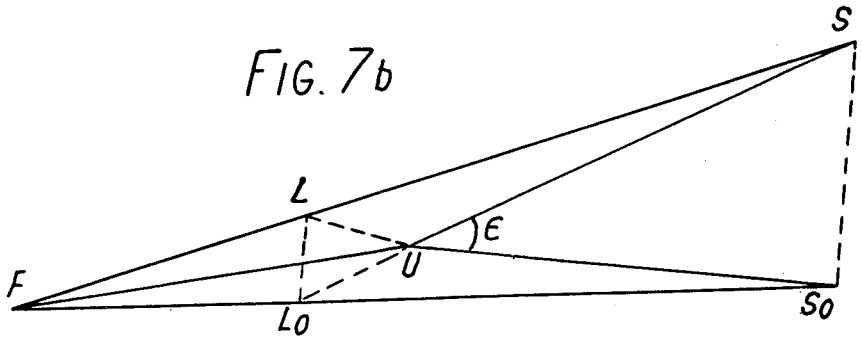

If $S_o$ is the projection of S in the horizontal plane, note (i) $\widehat{FUS}$ being 90 deg, $\widehat{FUS_o}<90$ deg, (ii) the angle between the lobe peak and the fold US ($\widehat{LUS}$ in FIG. 7*b*), which was formerly $\tan^{-1}\sqrt{2}$ must now be less. Call this angle K ($=\widehat{L_oUS_o}$ in FIG. 7*b*).

First calculate the lobe elevation. As it is a concomitant of heel ($\Psi$) it can usefully be called $\Psi_o$ ($=\widehat{LUL}$ in FIG. 7*b*). Note in FIG. 7*b* that $\widehat{SUF}$, $\widehat{SLU}$, $\widehat{SS_oF}$, $\widehat{SS_oU}$, $\widehat{LL_oU}$ and $\widehat{LL_oF}$ are all 90 deg.

Thus in $\Delta$s $LL_oF$ and $SS_oF$ $$\sin \widehat{LFL_o} = \frac{LL_o}{LF} = \frac{SS_o}{FS}$$

$$LL_o = \frac{SS_o\, LF}{FS}$$

Because $\sin \psi_o = \frac{LL_o}{UL}$ $$\sin \psi_o = \frac{SS_o\, LF}{FS\, UL} \tag{20}$$

But $SS_o = Us \sin \epsilon$ $$LF = \frac{US}{\sqrt{2}} \sin \tan^{-1}\left(\frac{1}{\sqrt{2}}\right)$$

$$FS = \frac{US}{\cos \tan^{-1}\left(\frac{1}{\sqrt{2}}\right)}$$

$$\text{and } UL = \frac{US}{\sqrt{2}} \cos \tan^{-1}\left(\frac{1}{\sqrt{2}}\right)$$

$$\text{Therefore } \sin \psi_o = \sin \epsilon \sin \tan^{-1}\left(\frac{1}{\sqrt{2}}\right) \tag{21}$$

Now find $K = \widehat{L_oUS_o}$, the angle between the azimuths of the directional axis of the lobe and the fold.

$$\cos K = \frac{UL_o}{US_o} = \frac{UL \cos \psi_o}{US \cos \epsilon} = \frac{\cos \tan^{-1}\left(\frac{1}{\sqrt{2}}\right) \cos \psi_o}{\sqrt{2} \cos \epsilon} \tag{22}$$

Lobe Azimuth Array

Considering the construction of FIGS. 1 and 2, which I call an ambiorse construction, with the sinistrorse folds Nos: 1, 2 and 3 on top, and No: 1 topmost. The spine before folding is shown in FIG. 2. Let us start at fold No: 3 for (ultimate) simplicity. Fold No: 3 defines the azimuth datum, 0°, in the horizontal projection shown in FIG. 8, where the construction is viewed from above. Each fold is tangential to the circle, radius $x_o$ which is the locus of the corners U. The face of the plate shown in FIG. 2 is defined as its 'front' face, and the odd-numbered folds (which are shown as chain lines in FIG. 2 and dotted in FIG. 8, and which have reference numerals encircled in FIGS. 2 and 8) are produced by folding the plate forwards for example see fold No: 3, i.e. the front is the face on which the corners 3L and 3R will be situated. The other face is the 'back', and the (even-numbered) backwards folds are shown as dot and chain lines in FIG. 2 and as solid lines in FIG. 8 and with reference numerals not circled in FIGS. 2 and 8. Adjacent folds are folded in opposite senses (FIG. 2), i.e. the plate is folded from top to bottom alternately forwards and backwards, with odd-numbered folds forwards (encircled) and even-numbered folds backwards.

Going from ("start" in FIG. 8) Fold No: 3 to Fold No: 2 up the sinistrorse helix causes a right-hand turn through the twist angle (=2γo=35.8° in this example). Similarly going from Fold No: 2 to Fold No: 1 causes the same 35.8° right-handed turn. These are shown in FIG. 8.

Fold No: 4 is parallel to Fold No: 3, and is of opposite sense. It is the uppermost of the three (Nos: 4, 5 and 6) dextrorse folds forming the bottom half of the whole construction. Going from Fold No: 4 to Fold No: 5 down the dextrorse helix causes a right-hand turn through the twist angle, and similarly again from Fold No: 5 to Fold No: 6 ("Finish").

Figure 8:
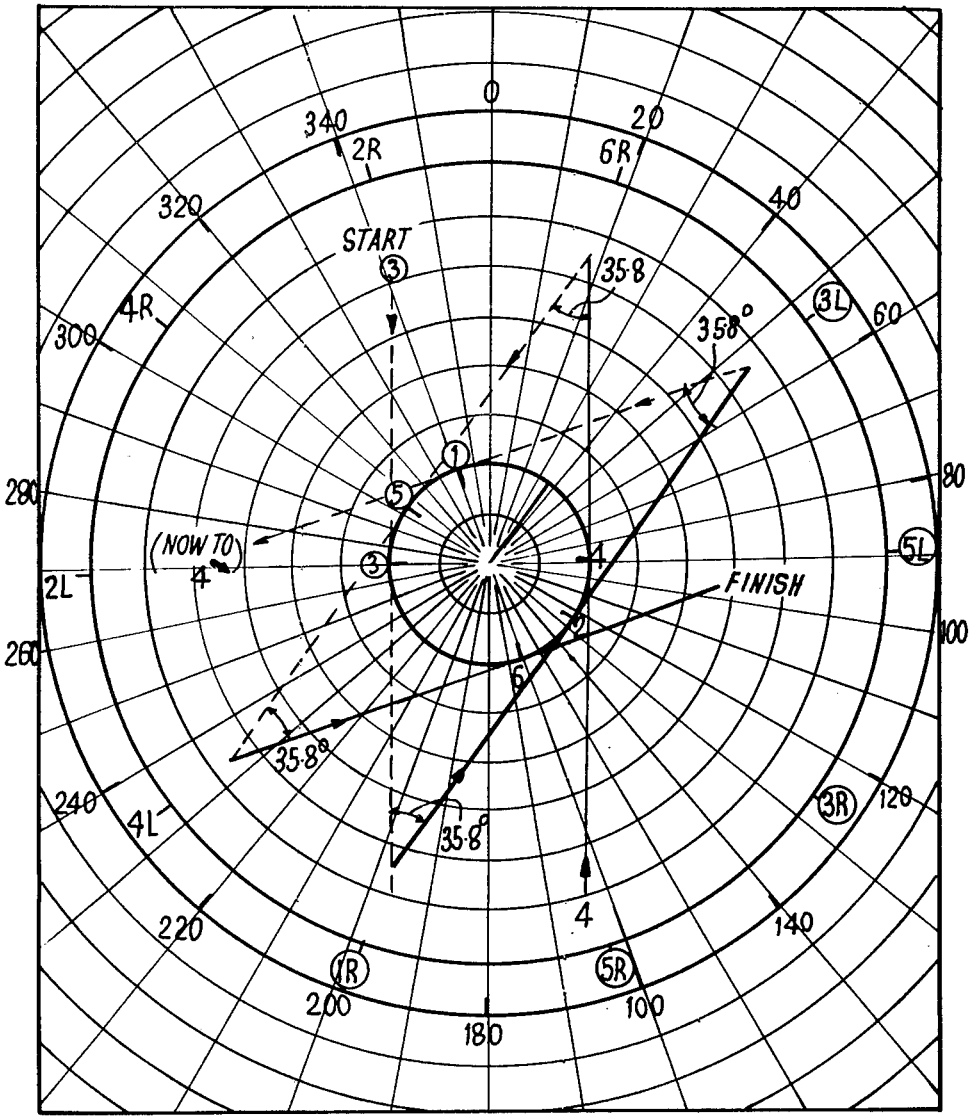
FIG. 8 is a polar diagram showing schematically the construction viewed from above.

The horizontal projection of each pair of corners for each fold is shown in FIG. 8 following the construction described above. In the following Table 1 are shown the fold azimuths (left and right, when viewing from behind the reflector, i.e. towards the central axis). Hence the lobe azimuths (left and right) for each fold are given, being K degrees (see Eqn. 22) into each corner from each fold azimuth. The lobe azimuths for the dextrorse helix are exactly at 180° to those for the enantiomorphic sinistrorse helix. The lobe azimuths are shown around FIG. 8.

TABLE 1

| | Fold No: | Fold Azimuths, deg | Lobe Azimuths deg. | | Lobe Elevation* |
|---|---|---|---|---|---|
| | 1 | (L) 71.6, 251.6 (R) | (L | 125.1) | (−) |
| | | | R | 198.1 | + |
| ↑ | 2 | (R) 35.8, 215.8 (L) | L | 269.3 | − |
| | | | R | 342.3 | + |
| ↑ | 3 | (L) 0 , 180 (R) | L | 53.5 | − |
| — | | | R | 126.5 | + |
| Θ | 4 | (R) 0 , 180 (L) | L | 233.5 | + |
| | | | R | 306.5 | − |
| ↓ | 5 | (L) 35.8, 215.8 (R) | L | 89.3 | + |
| | | | R | 162.3 | − |
| | 6 | (R) 71.6, 251.6 (L) | (L | 305.1) | (+) |
| | | | R | 18.1 | − |

*9.77 deg above (+) or below (−) the horizon.

Thus the whole 360 degrees of azimuth are covered by 12 corners with two overlapping pairs, one corner of each of which can be eliminated as they are at opposite ends of the construction (1L and 6L, bracketted in the Table), leaving 10 lobes. So the azimuthal sequence of the remaining lobes is as in Table 2.

TABLE 2

| | | | | |
|---|---|---|---|---|
| Lobe No: | 6R | 3L | 5L | 3R |
| Elevation | − | − | + | + |
| Azimuth, deg. | 18.1 | 53.5 | 89.3 | 126.5 |
| Spacing, deg. | 35.4 | 35.8 | 37.2 | |
| Deviation from 36.0° | −0.6 | −0.2 | +1.2 | |
| Lobe No: | 3R | 5R | 1R | |
| Elevation | + | − | + | |
| Azimuth, deg. | 126.5 | 162.3 | 198.1 | |
| Spacing, deg. | 37.2 | 35.8 | 35.8 | |
| Deviation from 36.0° | +1.2 | −0.2 | −0.2 | |
| Lobe No: | 1R | 4L | 2L | |
| Elevation | + | + | − | |
| Azimuth, deg. | 198.1 | 233.5 | 269.3 | |
| Spacing, deg. | 35.8 | 35.4 | 35.8 | |
| Deviation from 36.0° | −0.2 | −0.6 | −0.2 | |
| Lobe No: | 2L | 4R | 2R | |
| Elevation | − | − | + | |
| Azimuth, deg. | 269.3 | 306.5 | 342.3 | |
| Spacing, deg. | 35.8 | 37.2 | 35.8 | |
| Deviation from 36.0° | −0.2 | +1.2 | −0.2 | |
| Lobe No: | 2R | 6R | etc | |
| Elevation | + | − | | |
| Azimuth, deg. | 342.3 | 18.1 | | |
| Spacing, deg. | 35.8 | 35.8 | | |
| Deviation from 36.0° | −0.2 | −0.2 | | |

Figure 9:
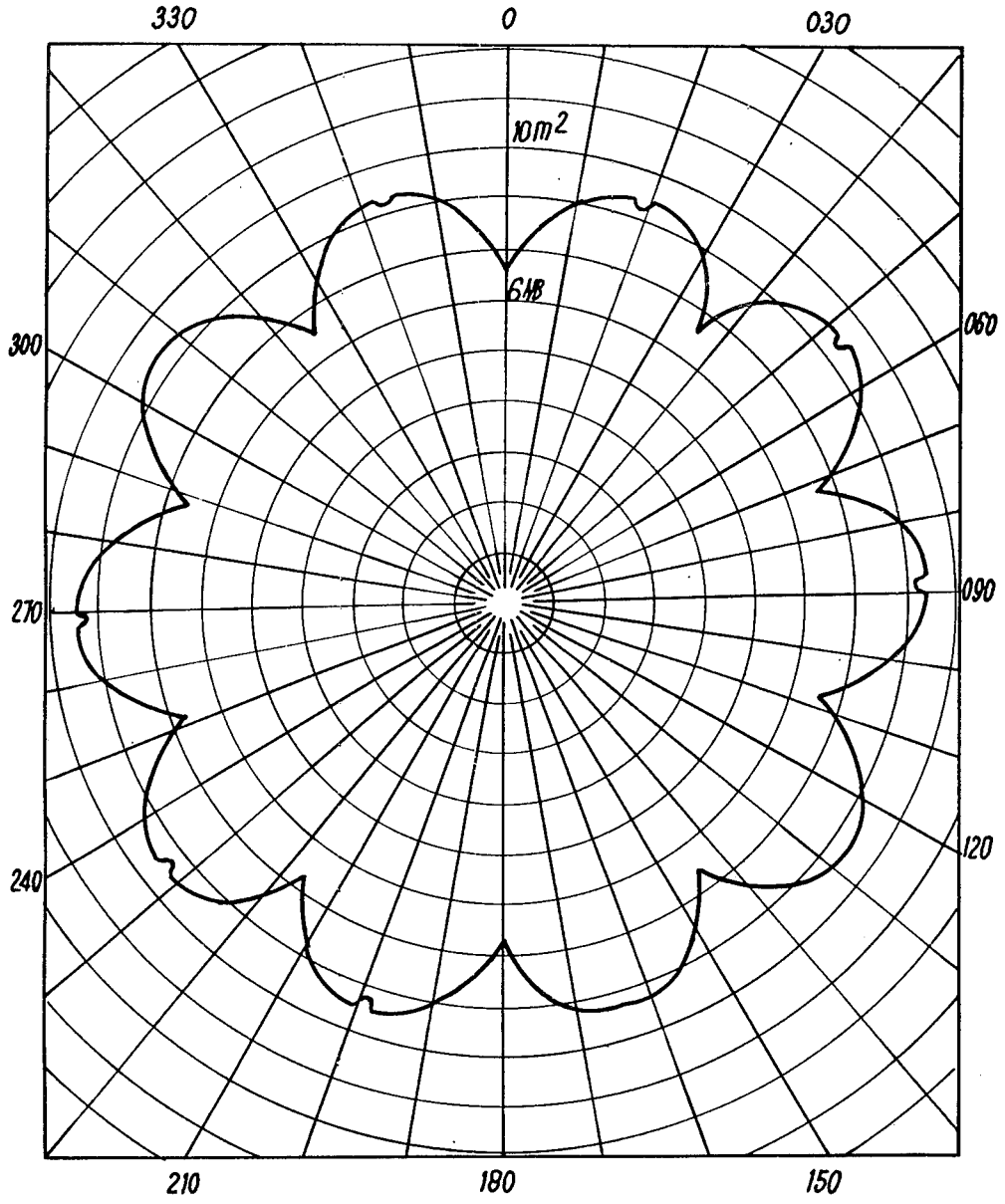
FIG. 9 is a predicted polar diagram showing the response of the radar reflector.

That is to say, the 10 corners are disposed substantially evenly around the azimuth, as indicated in FIG. 9.

Figure 10:
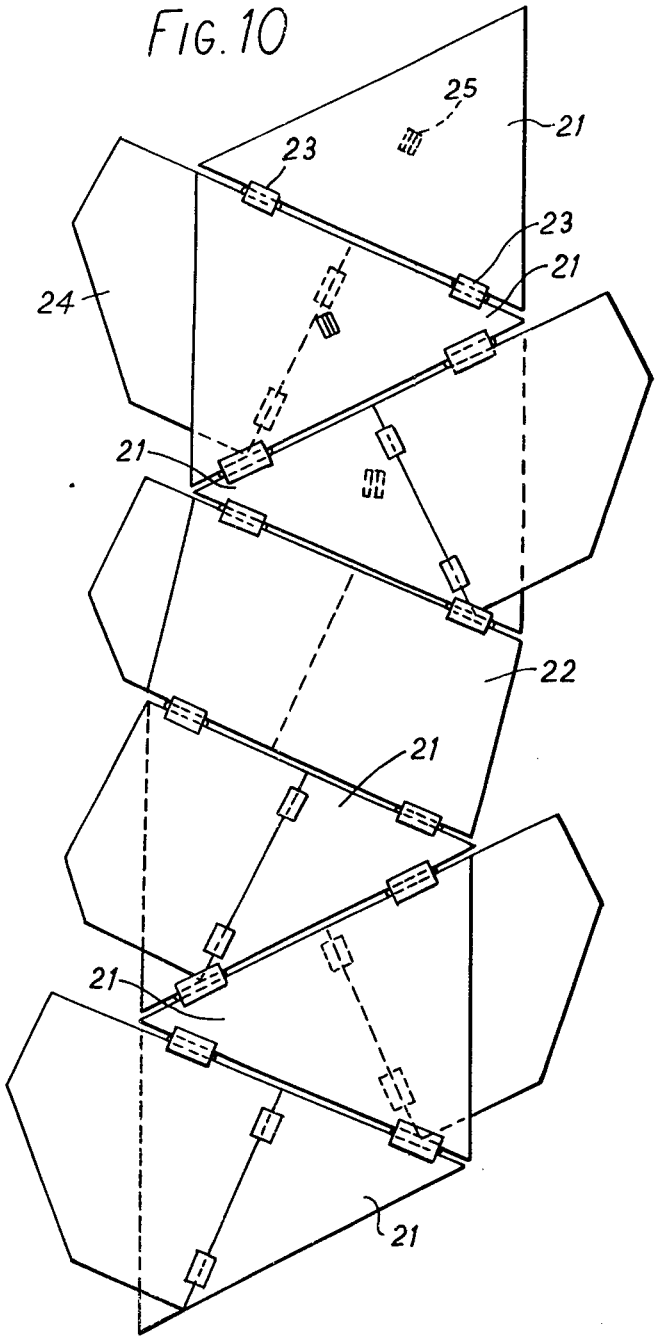
FIG. 10 is a side view of a demountable reflector constructed in accordance with the invention and folded into a flat condition.

An alternative collapsible version of a reflector in accordance with the invention is shown in FIG. 10. In this embodiment sections 21 and 22 of radar reflective sheet material are hingedly interconnected in edge to edge relationship to form a strip by means of hinges 23. The portions 21 are of similar shaping to the portions 11 and the portion 22 is of similar shaping to the portion 12 of FIG. 2. The hinges permit the strip to be folded backwards and forwards in concertina fashion into a small space. The opposite edges of the portion 22 which are hingedly connected to adjacent portions 21 are substantially parallel. The hingedly connected edges of the other portions 21 are alternately divergent and convergent in a direction from one edge to the other edge of the sectional strip.

Each of the portions 21 and 22 except the top portion is provided with a separator plate 24 which are hingedly connected to their respective portion alternately to opposite faces of the plate. The separator plates are shaped and positioned so as to be movable into a position at right angles to their respective portion and to permit the adjacent portion to be hinged into contact therewith at which position the adjacent portions are mutually at right angles. A clip 25 is provided which engages the edge of the separator plate and secures the plate in position. The two adjacent portions and the separator plate form a pair of orthogonal re-entrant trihedrals in the same form as FIG. 1.

It will be appreciated that this version of the reflector can be folded down for storage in a confined space yet is quickly reassembled for use.

It is believed that the constructions described fully meet the stringent performance requirements of the Department of Trade Marine Radar Reflector Performance Specification 1977. In particular, since the response for the vertical plane is also extremely good the vertical angle response, so important to maintain reflection during heeling in rough seas, meets the requirement that the vertical coverage, $\pm 15°$ to the horizontal, shall not remain below $-6$ dB relative to the 10 $m^2$ value over any single angle of more than 1.5°.

It will be appreciated that more or less reflective corners could be employed and that provided at least six are distributed around a 360° arc, a useful construction may be obtained. Reflectors employing more than 10 reflective corners in which overlapping of lobes at higher signal strengths occurs may well provide useful constructions and such constructions are at present being analysed as their usefulness is influenced by their response at different heeling angles as well as by several other complex factors.

Although the spine and dividers of the described reflector are formed from a single sheet of material the invention is not restricted to such a construction and any other radar reflective material can be employed. For example, the whole could be moulded in plastics e.g. by injection moulding. Such a moulding could be effected with a moulding material containing particles of radar reflective material so that these particles are embedded in the moulded reflector. Another possibility is the provision of facings of radar reflective material on a plastics moulded construction e.g. by metal plating or metalization.

A radar reflector as previously described may be encapsulated or hermetically sealed in a container of for example glass reinforced plastics material.

It will be understood that the above description of the present invention is susceptible to various modification changes and adaptations.

What is claimed is:

1. A radar reflector having a major axis and comprising at least six corner reflectors directed outwardly of said major axis and disposed along two successive helical paths one of which paths is sinistrorse and the other of which paths is dextrorse.

2. A radar reflector according to claim 1, wherein the reflectors are evenly distributed within an angle of 360°.

3. A radar reflector as claimed in claim 2 comprising ten corner reflectors.

4. A radar reflector according to claim 1, wherein the corner reflectors are orthogonal re-entrant trihedrals.

5. A radar reflector according to claim 4, comprising a strip of radar reflective sheet material folded in alternate directions along fold axes spaced apart on the strip and extending transversely across the strip with two consecutive ones of the fold axes disposed intermediately being substantially parallel and the remaining folds being alternately convergent and divergent in a direction from one edge to the opposite edge of the strip the folds dividing the strip into sections adjacent sections being disposed at right angles and a separator plate being provided between and at right angles to each pair of adjacent sections to form therewith two corner reflectors.

6. A radar reflector according to claim 5, wherein the separator plates are rectangular.

7. A radar reflector according to claim 5, wherein the separator plates are rectangular with one point cut off to provide an edge and are each positioned such that said edge is remote from adjacent sections.

8. A radar reflector according to claim 5 wherein the strip is profiled to provide an edge profile conforming to part of the internal surface of a cylinder.

9. A radar reflector as claimed in claim 5 including a cylindrical housing containing the profiled strip with separator plates.

10. A radar reflector according to claim 5 wherein the separator plates are profiled to provide an edge profile conforming to part of the internal profile of said cylinder.

11. A radar reflector according to claim 3, comprising a strip of radar reflective sheet material formed by a multiplicity of sheet sections having edges in edge to edge relationship extending across the strip, said edges of an intermediate one of the sections being substantially parallel and the remaining ones of said edges being alternately convergent and divergent in a direction from one edge to the opposite edge of the strip, and for each pair of adjacent sections hinge means coupled between said sections and adapted to permit hinged movement of said sections into a position where they are mutually at right angles and a separator plate hingedly connected to one of said sections adapted to permit hinged movement into a position at right angles to each of said pair of adjacent sections to form therewith two corner reflectors.

* * * * *